United States Patent [19]

Beers

[11] 4,286,831

[45] Sep. 1, 1981

[54] FOLDING FURNITURE

[76] Inventor: Robert E. Beers, 20 Georgian Rd., Morristown, N.J. 07960

[21] Appl. No.: 197,175

[22] Filed: Oct. 15, 1980

Related U.S. Application Data

[63] Continuation of Ser. No. 17,850, Mar. 6, 1979.

[51] Int. Cl.[3] ..... A47B 43/00

[52] U.S. Cl. ..... 312/258; 312/330 R; 312/195; 108/124; 248/167

[58] Field of Search ..... 312/195, 258, 262, 330 R; 108/115, 79, 38, 35, 36, 124; 248/174, 167

[56] References Cited

U.S. PATENT DOCUMENTS

| | | | |
|---|---|---|---|
| 1,894,145 | 1/1933 | Andler | 108/38 |
| 2,079,639 | 5/1937 | Swensson | 108/124 |
| 2,750,243 | 6/1956 | Zielfeldt | 108/115 |
| 3,104,138 | 9/1963 | Renaud | 312/195 |
| 3,123,416 | 3/1964 | Sovik, Jr. | 312/195 |
| 3,817,191 | 6/1974 | Hansen et al. | 248/167 |
| 3,825,310 | 7/1974 | Roemer | 312/330 R |
| 4,046,084 | 9/1977 | Hosford et al. | 312/258 X |

FOREIGN PATENT DOCUMENTS

| | | | |
|---|---|---|---|
| 628080 | 8/1949 | United Kingdom | 108/115 |

*Primary Examiner*—Francis K. Zugel

*Attorney, Agent, or Firm*—Hopgood, Calimafde, Kalil, Blaustein & Judlowe

[57] ABSTRACT

Folding furniture is herein described which generally comprises two planar members hinged about contiguous edges thereof. One member may be generally uninterrupted in its planar extension while the other may be cut to form various structural support members. The second member is formed with two opposed faced, generally C-shaped members which are hinged to the second member. The C-shaped members are swingable outwardly to support the first member in a horizontal plane as well as to support the entire structure in an operational posture as a desk or table.

3 Claims, 6 Drawing Figures

FOLDING FURNITURE

This application is a continuation of application Ser. No. 17,850 filed Mar. 6, 1979.

BACKGROUND OF THE INVENTION

The present invention relates to folding furniture and, in particular, to a "knock down" desk or table which may be folded into an uniquely thin storage configuration. Additionally, a modular drawer/file feature is provided which permits easy installation and/or removal of such drawer/file with respect to the assembled table or desk. The modular aspect of the drawer/file also facilitates the storage and/or shipment thereof.

Today, there is an increasing need for furniture which, while being suitably stable during use, may be folded into extremely small or thin configurations for either storage or transportation.

Heretofore, such folding furniture has often presented disadvantages such as flimsiness or instability in the operational state, undue expense, difficulty in opening to an operational state, excessive weight, an unattractive appearance or undue bulk in the folded state.

OBJECTS AND SUMMARY OF THE INVENTION

It is therefore an object of the present invention to provide a piece of folding furniture which is remarkably stable when opened to its operational configuration.

It is another object of the present invention to provide folding furniture which is relatively light in weight.

It is still another object of the present invention to provide folding furniture which may be folded to present a very thin profile for convenient storage and/or shipping.

It is yet another object of the present invention to provide folding furniture which is uniquely attractive while being inexpensive to manufacture.

At least some of the above mentioned objectives are achieved by the provision of a piece of folding furniture comprising two planar members relatively hinged with respect to each other along contiguous edges. One of the said members may present a generally uninterrupted planar surface suitable as a desk or table top. The second planar member may be cut to form two generally C-shaped support members which are hingedly attached in mutually opposed faced relationship to the remaining part of the second member along a hinge axis extending generally perpendicular to the first mentioned hinge. The two C-shaped members are formed so as to support the first planar member in a generally horizontal plane while simultaneously supporting the overall structure on a supporting surface in the form of an upright desk or table.

DETAILED DESCRIPTION OF THE DRAWINGS

While the invention is particularly pointed out and distinctly claimed in an concluding portion of the specification, a preferred embodiment is set forth in the following detailed description which may be best understood by reference to the accompanying drawings in which:

DETAILED DESCRIPTION OF THE PREFERRED EMBODIMENT

Figure 1:
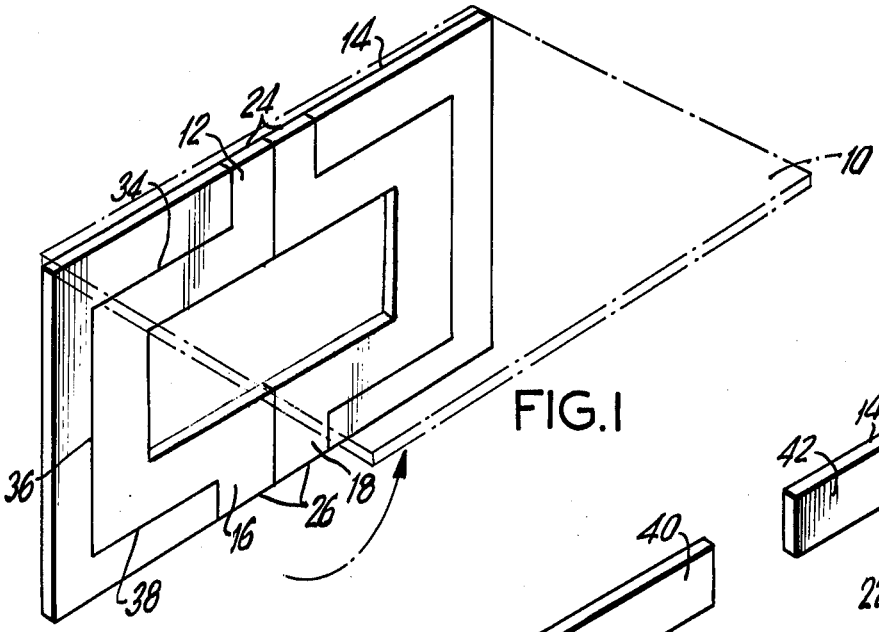
FIG. 1 is a perspective view showing two planar members comprising folding furniture according to the present invention.

Referring now to the drawings in which like numerals are used to indicate like parts throughout the various views thereof, FIG. 1 generally shows two planar members 10 and 12 which are mutually hinged about contiguous, horizontally extending edges thereof shown at 14.

The planar member 10 may be surface treated, such as by a veneer, to serve as an attractive table or desk top.

The planar member 12 may be cut and formed so as to define two generally C-shaped structural support members 16 and 18.

Figure 2:
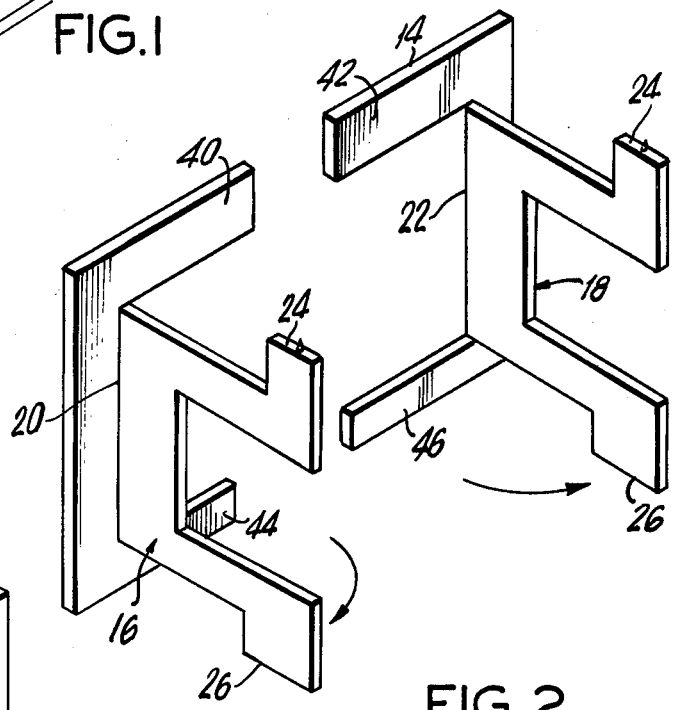
FIG. 2 is a perspective view of the structure of FIG. 1, showing supporting, generally C-shaped members hinged for movement into a position supporting an overall piece of furniture according to the present invention.

Referring to FIG. 2, the C-shaped members 16 and 18 are shown in an operational posture where each has been swung inwardly about hinges 20 and 22, the axes of which hinges extend generally perpendicular to the hinge at 14.

Each C-shaped member 16 and 18 may be formed with an upwardly extending tab 24 upon which the planar member 10 rests. Similarly, each C-shaped member 16 and 18 may be formed with a downwardly extending tab member 26 which engages the supporting surface of the overall piece of furniture.

In order to provide the overall structure with maximum stability, the C-shaped members 16 and 18 are formed in member 12 as mutually opposed faced members which configuration thereby permits the hinged closed end of each C-shaped member to be positioned longitudinally outwardly away from the center of the overall structure.

Figure 3:
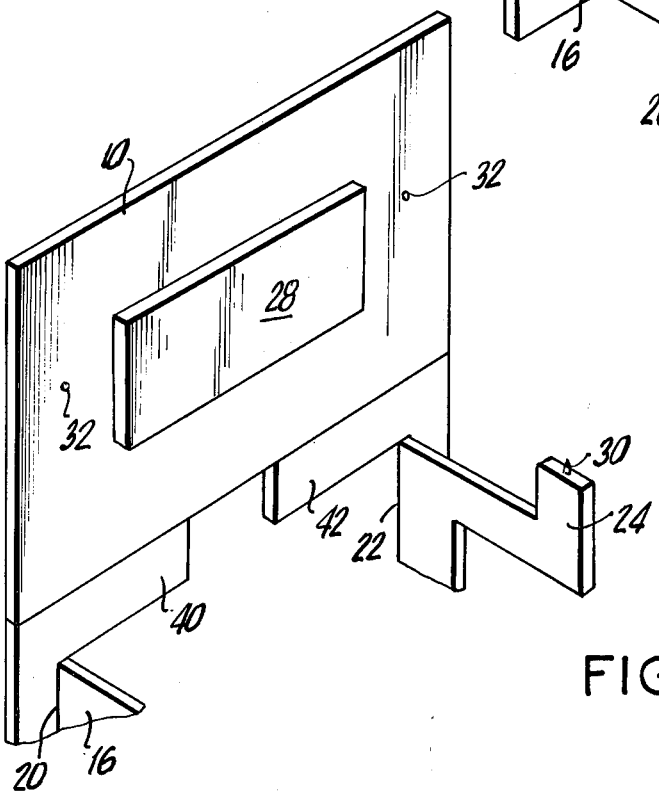
FIG. 3 is a perspective view showing the underside of the first planar member of a piece of folding furniture according to the present invention.

Referring to FIG. 3, it can be seen that the portion 28 of member 12 which was cut from member 12 to form the opposed faced C-shaped members 16 and 18 may be attached centrally to the underside of the table/desk top member 10. In this way, the overall structure has more stability and strength when the furniture is folded into a thin configuration for storing.

A locating pin 30 may be provided on the upper surface of each of the tabs 24 for engagement within a locating hole 32 formed in the underside of the table/desk surface member 10.

When the pin is inserted within the opening 32, the C-shaped members 16 and 18 are held against any swinging movement about the axes 20 and 22.

Because the C-shaped members are cut from planar member 12 so that each of the three outer sides 34, 36 and 38 of each C-shaped member are wholly within the perimeter of the second planar member 12, with only tabs 24 and 26 extending to the outer perimeter of the planar member 12, exceptional strength and stability are provided for the horizontally extending table/desk surface 10.

More specifically, because the C-shaped members are formed wholly within the perimeter of the planar member 12, horizontally extending supports 40 and 42 project inwardly along a substantial length of the hinged side of the planar member 10. Likewise, horizontally extending supports 44 and 46 extend in opposed relationship over a substantial length of the overall piece of furniture to support the furniture with respect to the supporting floor or other surface.

Figure 4:
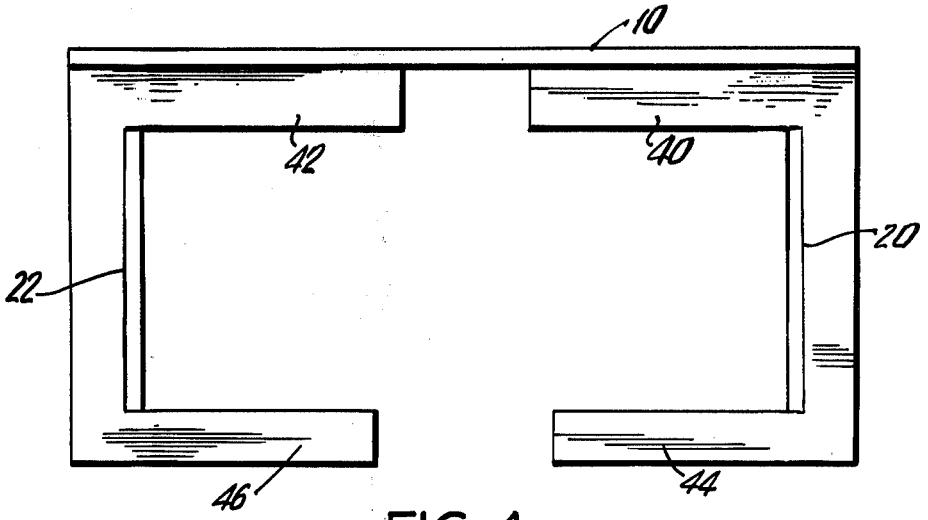
FIG. 4 is an elevation view showing the front of a piece of folding furniture according to the present invention which furniture has been opened into an operational posture.
Figure 5:
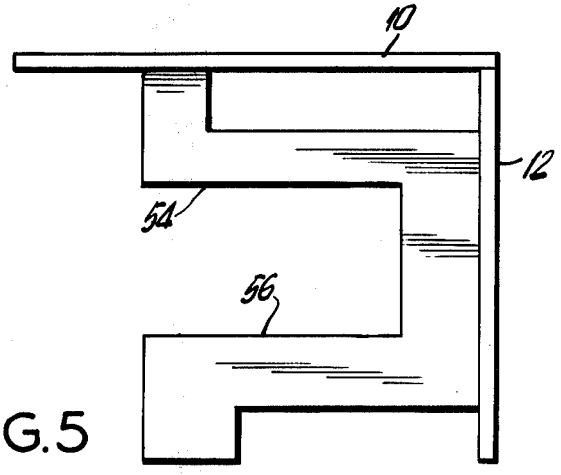
FIG. 5 is a side view of the erected piece of folding furniture shown in FIG. 4.

FIGS. 4 and 5 show the folding furniture of FIGS. 1-3 opened to a fully operational posture.

Figure 6:
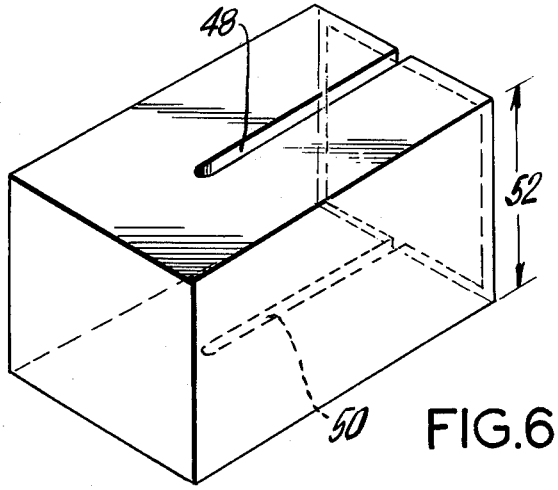
FIG. 6 is a perspective view of a modular drawer/file formed to be usable in association with the erected furniture shown in FIGS. 4 and 5.

Referring now to FIG. 6, a modular drawer/file is shown having a groove or the like 48 formed in the upper surface thereof and a corresponding groove 50 formed in the lower surface thereof.

The height 52 of the drawer/file is such that grooves 48 and 50 slideably engage within surfaces 54 and 56 of the fully assembled folding table/desk to support the drawer/file so that the drawer/file becomes an operational part thereof.

While what has been described herein is the preferred embodiment of the present invention, it is of course understood that various modifications and changes may be made therein without departing from the true spirit and scope of the invention.

It is therefore intended to cover in the following claims all such modifications and changes as may fall within the true spirit and scope of the present invention.

What is claimed is:

1. A piece of folding furniture comprising two planar members hinged about contiguous edges thereof, one of said members being suitable as a horizontal surface for a piece of furniture, the second said planar member being formed to define two generally C-shaped support elements hingedly attached to said second member and movable from the plane of said second member to a position supporting said first planar member in a horizontal posture, said two support elements being hingedly attached for movement away from the central area beneath said horizontal surface to define an open space for receiving the legs of a person sitting at said piece of folding furniture, at least one of said generally C-shaped support elements being formed to removably receive a file/drawer member, said file/drawer member being formed with means for slidingly removable, mounting engagement within the C-shaped structure of said at least one of said generally C-shaped support elements.

2. A piece of folding furniture comprising two planar members hinged about contiguous edges thereof, one of said members being suitable as a horizontal surface for a piece of furniture, the second said planar member being formed to define two support elements hingedly attached to said second member and movable from the plane of said second member to a position supporting said first planar member in a horizontal posture, said two support elements comprising mutually opposed faced C-shape elements hingedly attached to said second member along the closed portion of each said C-shape, each said C-shape member being formed wholly within the perimeter of said second planar member with the exception of tabs formed at the ends of each said C-shape member, said tabs extending to the outer perimeter of said second planar member with one of said tabs operable to support said first planar member in a horizontal posture and the second said tab being operable to engage the surface supporting the overall piece of folding furniture.

3. A piece of folding furniture according to claim 2, with the addition of a file/drawer member, said file/drawer member being formed with means on the upper and lower surfaces thereof for mounting engagement within the C-shaped structure of one of said C-shape support members.

* * * * *